US010116083B2

(12) United States Patent
Lin

(10) Patent No.: US 10,116,083 B2
(45) Date of Patent: Oct. 30, 2018

(54) NETWORK CABLE CONNECTOR

(71) Applicant: JYH ENG TECHNOLOGY CO., LTD., New Taipei (TW)

(72) Inventor: Yen-Lin Lin, New Taipei (TW)

(73) Assignee: JYH ENG TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 15/821,858

(22) Filed: Nov. 24, 2017

(65) Prior Publication Data

US 2018/0269618 A1 Sep. 20, 2018

(30) Foreign Application Priority Data

Mar. 17, 2017 (TW) ..... 106203790 U

(51) Int. Cl.

| | |
|---|---|
| ***H01R 13/502*** | (2006.01) |
| ***H01R 13/506*** | (2006.01) |
| ***H01R 13/512*** | (2006.01) |
| ***H01R 13/52*** | (2006.01) |
| ***H01R 13/58*** | (2006.01) |
| ***H01R 24/64*** | (2011.01) |
| *H01R 107/00* | (2006.01) |

(52) U.S. Cl.

CPC ..... *H01R 13/5025* (2013.01); *H01R 13/506* (2013.01); *H01R 13/512* (2013.01); *H01R 13/5205* (2013.01); *H01R 13/582* (2013.01); *H01R 13/5833* (2013.01); *H01R 24/64* (2013.01); *H01R 2107/00* (2013.01); *H01R 2201/04* (2013.01)

(58) Field of Classification Search

CPC ..... H01R 13/5025; H01R 13/506; H01R 13/512; H01R 13/5205; H01R 13/582; H01R 13/5833; H01R 13/59; H01R 24/64

See application file for complete search history.

(56) References Cited

U.S. PATENT DOCUMENTS

| | | | | |
|---|---|---|---|---|
| 6,149,455 | A * | 11/2000 | Levi | H01R 13/59 439/321 |
| 6,648,674 | B1 * | 11/2003 | Dobler | H01R 13/5841 439/455 |
| 7,878,832 | B2 * | 2/2011 | Hui | H01R 13/52 439/271 |
| 7,938,674 | B2 | 5/2011 | Lindkamp et al. | |
| 8,246,377 | B2 | 8/2012 | Lindkamp et al. | |

(Continued)

*Primary Examiner* — James Harvey
*Assistant Examiner* — Oscar Jimenez
(74) *Attorney, Agent, or Firm* — Leong C. Lei

(57) ABSTRACT

A network cable connector includes: a main body having a containing portion and a pushing pipe communicated to each other; and a hollow compression device for passing a network cable and having a fastener, a clamping part and a sleeve member. The clamping part installed in the fastener has plural compression parts at an end of the clamping part, and the other end of the clamping part is a pushing part. The sleeve member covers the end of the fastener coupled to the main body and has a curved inner surface tapered from an end near the fastener to the other. When the hollow compression device and main body are secured by screwing, the pushing pipe pushes the pushing part to move the clamping part towards the sleeve member, and the compression parts compresses the curved inner surface of the sleeve member to clamp the network cable tightly.

10 Claims, 10 Drawing Sheets

(56) References Cited

U.S. PATENT DOCUMENTS

| | | | | |
|---|---|---|---|---|
| 8,262,406 | B2 | 9/2012 | Lindkamp | |
| 8,657,626 | B2 * | 2/2014 | Duval | H01R 13/5205 439/583 |
| 8,766,109 | B2 * | 7/2014 | Duval | H01R 13/59 174/650 |
| 9,553,402 | B2 * | 1/2017 | Thelen | H01R 13/502 |
| 2006/0144611 | A1 * | 7/2006 | Chiu | H01R 9/03 174/74 R |
| 2013/0224989 | A1 * | 8/2013 | Giefers | H01R 13/512 439/452 |
| 2015/0280349 | A1 | 10/2015 | Thelen | |
| 2015/0280360 | A1 | 10/2015 | Thelen | |

* cited by examiner

NETWORK CABLE CONNECTOR

CROSS-REFERENCE TO RELATED APPLICATIONS

This non-provisional application claims priority under 35 U.S.C. § 119(a) on Patent Application No(s). 106203790 filed in Taiwan, R.O.C. on Mar. 17, 2017, the entire contents of which are hereby incorporated by reference.

FIELD OF INVENTION

The present invention relates to the field of network cable connectors, in particular to a network cable connector capable of tightening and fixing a network cable and providing both aesthetic and dustproof effects in addition of connecting the network cable with the connector more conveniently.

BACKGROUND OF INVENTION

1. Description of the Related Art

Network cable connector with the capability of improving the overall network jumper property has been used extensively. However, almost all of the conventional network cable connectors are fully sealed and just provide a hole for connecting the network cable, so that the wire connection process is relatively inconvenient.

For a high frequency network signal transmission or a compact assembly configuration, the diameter of a network cable is increased or decreased accordingly, so that the binding tail at the rear end of network cable connector may not fit the required connection. If the diameter of the binding tail has a diameter in compliance with the network cable of a larger diameter and a user wants to use a network cable with a smaller diameter, then a too-large gap will be formed between the binding tail and the wire, and a protection effect cannot be achieved. On the other hand, a wire with a too-large diameter cannot be tightened securely at the tail, so that the network cable connector cannot be used. Although some manufacturers has add two different sizes for the binding tail base to overcome the aforementioned problem, yet the binding tail is smaller and may fall out or be missing unintentionally.

To overcome the unfitted size of the binding tail, an improvement as disclosed in U.S. Pat. No. 7,938,674 as shown in FIG. 1 is made, wherein a network cable connector 11 has a thread 111 and a plurality of bumps 112 formed on an inner side of the rear end of the network cable connector 11. After a network cable is plugged into the network cable connector 11, and a clamping part 12 with a plurality of oblique surfaces 121 configured to be corresponsive to the bumps 112 are installed in the network cable connector 11, and a locking screw 13 is provided to push the clamping part 12, so that the oblique surfaces 121 of the clamping part 12 are propped and pressed by the bumps 112 to withdraw inwardly to achieve the effect of clamping the network cable securely. As disclosed in U.S. Pat. No. 8,246,377, similar technical characteristics have been disclosed, wherein the network cable connector has an articulated arm disposed at the rear end of the network cable connector and protruded from an oblique surface. In other words, the clamping part is installed directly at the rear end of the network cable connector, and then a nut is provided and screwed to the rear end of the network cable connector, so that the nut props and presses the protruding oblique surface of the articulated arm to press the articulated arm inward, so as to achieve the effect of clamping the network cable.

However, the aforementioned patents relate to the method of clamping the network cable into the network cable connector. Although these methods can achieve the effect of fixing the network cable, yet the portion proximate to the rear end of the network cable connector, and the portion between the rear end of the network cable connector and the network cable still has a gap, so that foreign substances such as external dusts may enter from the gap or affect the signal transmission quality adversely. In addition, the network cable may be shaken freely at the rear end of the network cable connector, and such free loosened end not just affects the aesthetic appearance of the network cable connector only, but also makes user to have the doubt of whether or not the network cable is fixed securely.

In addition, the aforementioned structural design of the network cable connector has a length greater than the ordinary network cable connector, and it is necessary to bend the network cable to fit a limited using environment with a smaller space, and the bent network cable may create an issue of aligning the core lines at the bent position or having a wrong alignment and may even damage the network cable.

Therefore, another improvement as disclosed in U.S. Pat. No. 8,262,406 is made, wherein a network cable connector is coupled to a tail cover with a bent angle, and an end of the tail cover is designed to have grooves on three sides and an open status in the fourth side, and the rear end of the network cable connector has a protruding rail structure, and the opening at the fourth side of the tail cover is provided for accommodating the rail structure at the rear end of the network cable connector, and then the tail cover is closed to bend the network cable to a predetermined angle, and the closed tail cover is used to protect the bent network cable. In addition, U.S. Pat. Nos. 20150280349 and 20150280360 have disclosed similar technical characteristics.

However, the aforementioned bending methods have a problem, since the network cable connector having the bent tail cover is different from a general network cable connector. In other words, the network cable connector installed with the bent tail cover cannot be remove the bent tail cover freely, so that it is necessary to bend network cable first and the wire cannot exit from the network cable connector directly. As a result, users have to consider whether or not the configuration will not be changed for a long time before buying the network cable connector. For any change, the users have to reconnect or reinstall the network cable and the network cable connector. Obviously, such application is very inconvenient and troublesome.

In view of the aforementioned drawbacks of the prior art, the inventor of the present invention based on years of experience in the related industry to conduct extensive research and development, and finally provided a novel solution to overcome the drawbacks of the conventional network cable connector.

2. Summary of the Invention

Therefore, it is a primary objective of the present invention to overcome the aforementioned drawbacks of the prior art by providing a network cable connector that allows users to connect a network cable to a network cable connector more conveniently, provides an aesthetic appearance of the tied network cable, and prevent producing a gap between the rear end of the connector and the network cable to improve the dustproof effect.

To achieve the aforementioned and other objectives, the present invention provides a network cable connector, comprising: a main body, having a clamping base and a clamping cover, and an end of the clamping base being provided for plugging into a network jack, and the other end of the clamping base being extended to form a first connecting portion in an arc shape, and the clamping base having a containing portion for receiving the network cable, and the clamping cover being configured to be corresponsive to the containing portion and an end of the clamping cover being coupled to the clamping base through at least one first pivot, such that the clamping cover may be lifted open or closed with respect to the containing portion, and the other end of the clamping cover being extended to form an arc second connecting portion; wherein when the clamping cover is covered onto and engaged with the containing portion, the first connecting portion and the second connecting portion are formed into a pushing pipe, and the pushing pipe is communicated to the containing portion, and the outer surface of the pushing pipe has a plurality of outer threads; and a hollow compression device, being hollow for passing a network cable, and having a fastener, a clamping part and a sleeve member, and an end of the fastener having plurality of inner threads formed on an inner surface of the fastener and configured to be corresponsive to the outer threads, and the clamping part being installed in the fastener, and an end of the clamping part having a plurality of compression parts, and the other end of the clamping part being a pushing part, and the sleeve member being covered onto and engaged with an end of the fastener having the inner threads, and the inner surface of the sleeve member being a curved surface tapered from an end near the fastener to the other end; wherein when the hollow compression device and the main body are screwed and coupled securely, the pushing part is pushed by the pushing pipe to move the clamping part towards the sleeve member, so that the compression parts are compressed inwardly by the curved inner surface of the sleeve member to clamp the network cable tightly.

In addition, the sleeve member has two first latch members extended from and formed at the inner surface of the sleeve member, and the fastener has two first latch holes formed at an end having the inner threads and configured to be corresponsive to the first latch members respectively, and the fastener has two second latch members extended and formed from the inner surface of an end having the inner threads, and the sleeve member has two second latch holes formed thereon and configured to be corresponsive to the second latch members respectively, so that the sleeve member can be fixed onto the fastener to prevent it from falling off.

Preferably, the compression parts are partitioned and symmetrically configured, and the joint between each of the compression parts and the pushing part has a limit bump provided for preventing the clamping part to move freely in the fastener.

Preferably, the pushing part is in a tubular shape, and the pushing part has a diameter equal to the diameter of the pushing pipe, so that the pushing part can be pushed more easily.

Preferably, each of the compression parts has a compression bump extended inwardly from and formed at an end coupled to the pushing part for binding the network cable more stably and securely.

Another objective of the present invention is to provide a network cable connector that can be fixed stably without shaking after the network cable is bent, and the bent tail cover is detachably coupled to the network cable connector to provide a convenient installation for users.

To achieve the aforementioned and other objectives, the present invention provides a network cable connector, comprising: a main body, having a clamping base and a clamping cover, and an end of the clamping base being provided for plugging into a network jack, and the other end of the clamping base being extended and formed into a first connecting portion, and the clamping base having a containing portion provided for accommodating a network cable, and the clamping cover being configured to be corresponsive to the containing portion, and an end of the clamping cover being coupled to the clamping base by at least one first pivot, so that the clamping cover can be lifted open or closed with respect to the containing portion, and the other end of the clamping cover being extended and formed into a second connecting portion; wherein when the clamping cover is covered and engaged with the containing portion, the first connecting portion and the second connecting portion form a pushing pipe, and the pushing pipe is communicated to the containing portion, and the outer surface of an end of the pushing pipe has a plurality of outer threads; a direction changing member, for passing the network cable, and the direction changing member having a connection port and a connecting pipe, and the connection port and the connecting pipe being communicated to each other and having an included angle greater than or equal to 90 degrees and smaller than 180 degrees for changing the configuration direction of the network cable, and the connection port being coupled to the pushing pipe, the outer surface of the connecting pipe having a plurality of third threads; and a hollow compression device, being hollow, and provided for passing the network cable, and the hollow compression device having a fastener, a clamping part and a sleeve member, and an end of the fastener having a plurality of inner threads formed on the inner surface of the end of the fastener and configured to be corresponsive to the third threads, and the clamping part being installed in the fastener, and an end of the clamping part having a plurality of compression parts, and the other end of the clamping part having a pushing part, and the sleeve member being covered onto and engaged with an end of the fastener having the inner threads, and the inner surface of the sleeve member being a curved surface and tapered from an end near the fastener to the other end. Wherein, when the hollow compression device and the direction changing member are screwed securely, the pushing part is driven by the connecting pipe to move the clamping part towards the sleeve member, so that the compression parts are compressed inwardly by the curved inner surface of the sleeve member to clamp the network cable tightly.

In addition, the direction changing member comprises a first casing and a second casing, and the first casing and the second casing are coupled to each other by a second pivot for lifting open and closing the first casing and the second casing. Wherein, when the first casing and the second casing are engaged with each other and closed, the direction changing member forms the connection port and the connecting pipe to facilitate the connection of the direction changing member with the main body by clamping.

Preferably, the connection port has two limit parts symmetrically disposed thereon, and when the connection port and the pushing pipe are coupled, the limit parts are latched to an end of the pushing pipe corresponsive to the outer threads for installing the direction changing member to the main body and preventing the direction changing member from being pulled away by an external force or falling out.

Preferably, the sleeve member has two first latch members extended from and formed at the inner surface of the sleeve member, and the fastener has two first latch holes formed at the end having the inner threads and configured to be corresponsive to the first latch members respectively.

In addition, the fastener has two second latch members extended from and formed at the inner surface of the end having the inner threads, and the sleeve member has two second latch holes formed thereon and configured to be corresponsive to the second latch members respectively, so that the sleeve member can be fixed onto the fastener to prevent it from falling out.

Preferably, the compression parts are partitioned and symmetrically configured, and a limit bump is formed at the joint between each of the compression parts and the pushing part to prevent the clamping part from moving freely in the fastener.

Preferably, the pushing part is in a tubular shape, and the pushing part has a diameter equal to the diameter of the pushing pipe, so that the pushing part can be pushed more easily.

Preferably, each of the compression parts has a compression bump extended inwardly from and formed at an end coupled to the pushing part to facilitate users to bind the network cable more stably.

Therefore, the present invention makes the process of connecting wires more easily by lifting open the main body and prevents the network cable from shaking by adopting the hollow compression device. In addition, there is no gap between the rear end of the network cable connector and the network cable to improve the dustproof and aesthetic effects. Further, the direction changing member and the hollow compression device are linked, so that after the network cable is bent, the network cable will not be shaken by external force. With the feature of the detachable direction changing member, users may install or un-install the network cable more flexibly without the need of changing the network cable connector, so as to improve the convenience of use.

DESCRIPTION OF THE PREFERRED EMBODIMENTS

Figure 1:
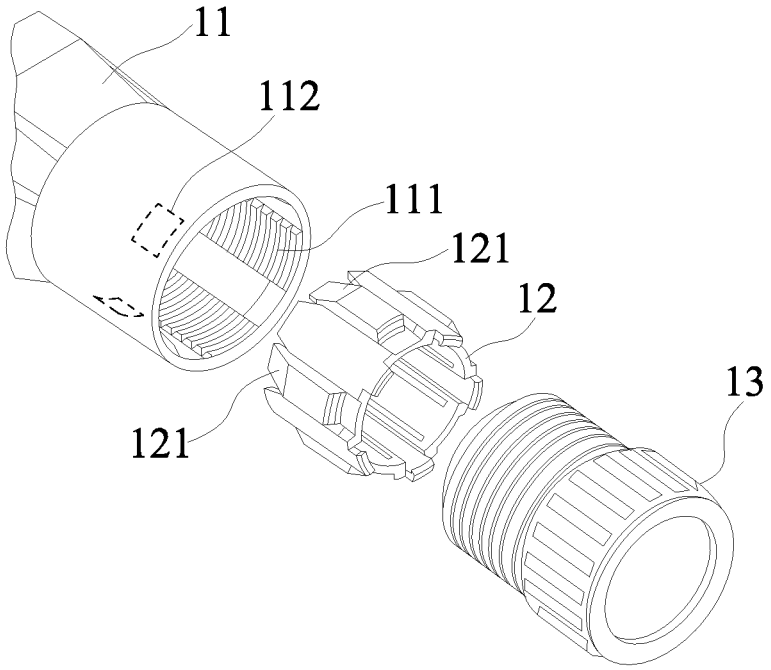
Fig. 1(PRIOR ART)
FIG. 1 is a schematic view of a conventional network cable connector.
Figure 2:
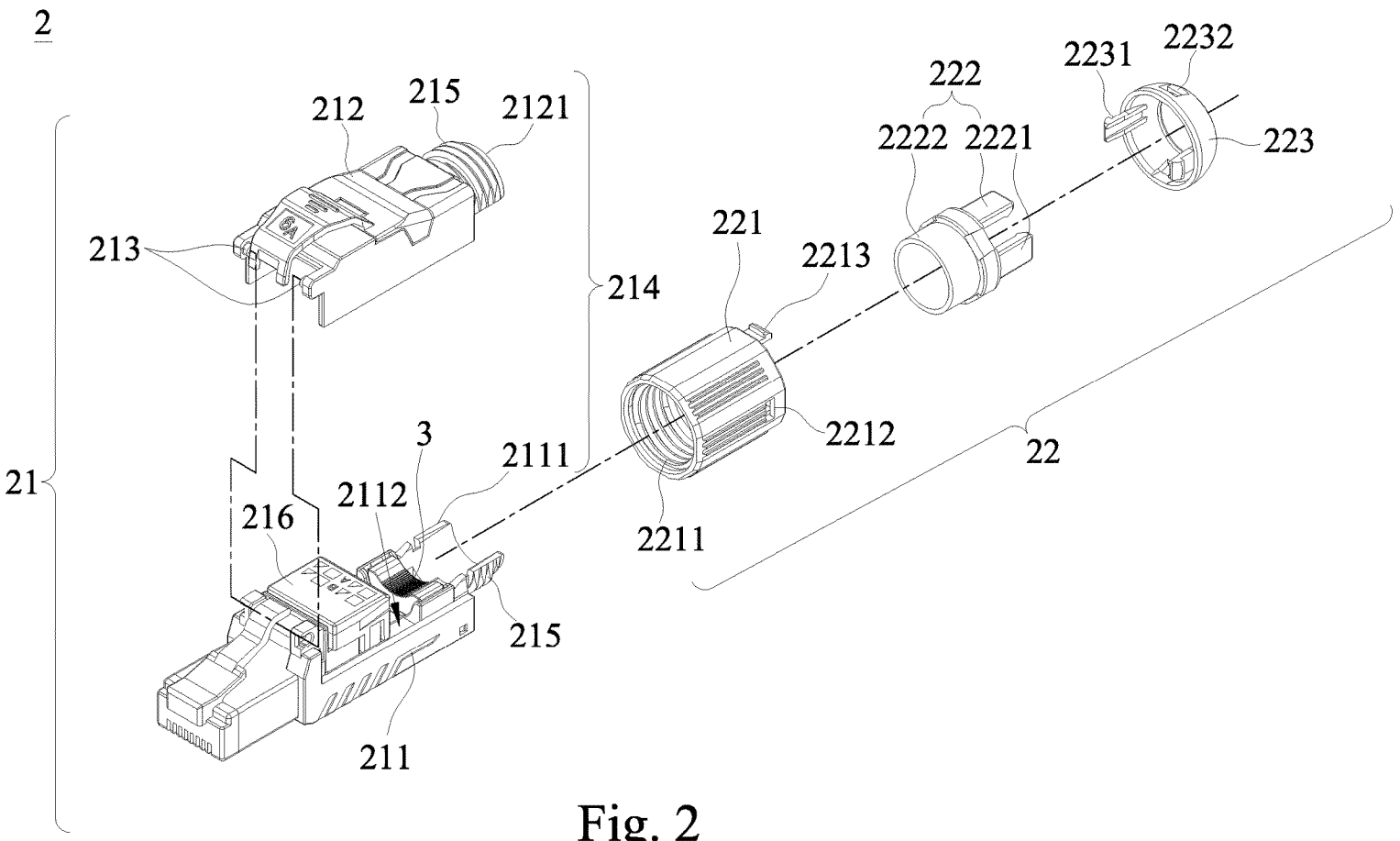
FIG. 2 is an exploded view of a network cable connector in accordance with a first preferred embodiment of the present invention.

The above and other objects, features and advantages of this disclosure will become apparent from the following detailed description taken with the accompanying drawings.

With reference to FIGS. 2, 5A-5C and 6 for the exploded view of a network cable connector of the first embodiment of the present invention and the schematic views of connecting wires, operating, binding or applying force to bind the network cable connector in accordance with the first embodiment of the present invention respectively, the network cable connector 2 comprises a main body 21, an elastic ejection block 3 and a hollow compression device 22. The main body 21 has a front end plugged into an external network jack (not shown in the figure) and an end plugged into an external network cable 4, and the main body 21 has a clamping base 211 and a clamping cover 212, and the clamping cover 212 is pivotally coupled to the clamping base 211, so that when the clamping cover 212 is opened, the network cable 4 may be accommodated and various electronic connectors, ICs or circuit boards may be installed therein, and when the clamping cover 212 is covered and engaged with the clamping base 211, a pushing pipe 214 is formed, and the pushing pipe 214 has an outer thread 215 formed thereon.

Figure 6:
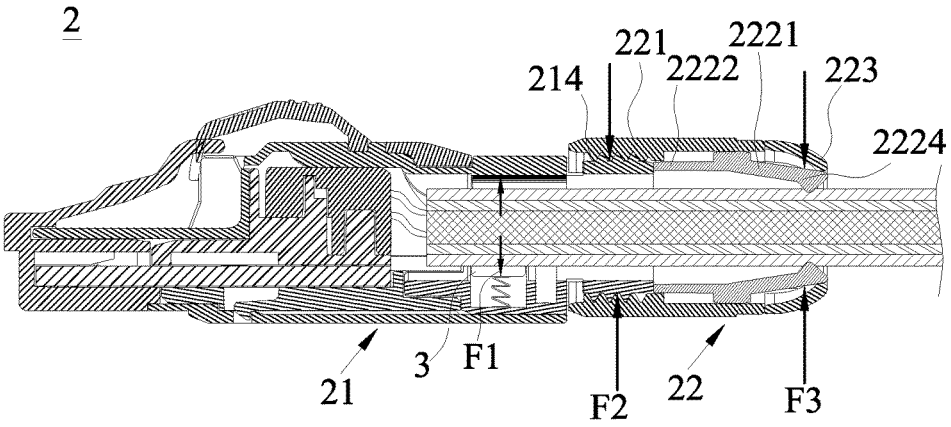
FIG. 6 is a schematic view of applying force to tighten the network cable connector in accordance with the first preferred embodiment of the present invention.
Figure 7:
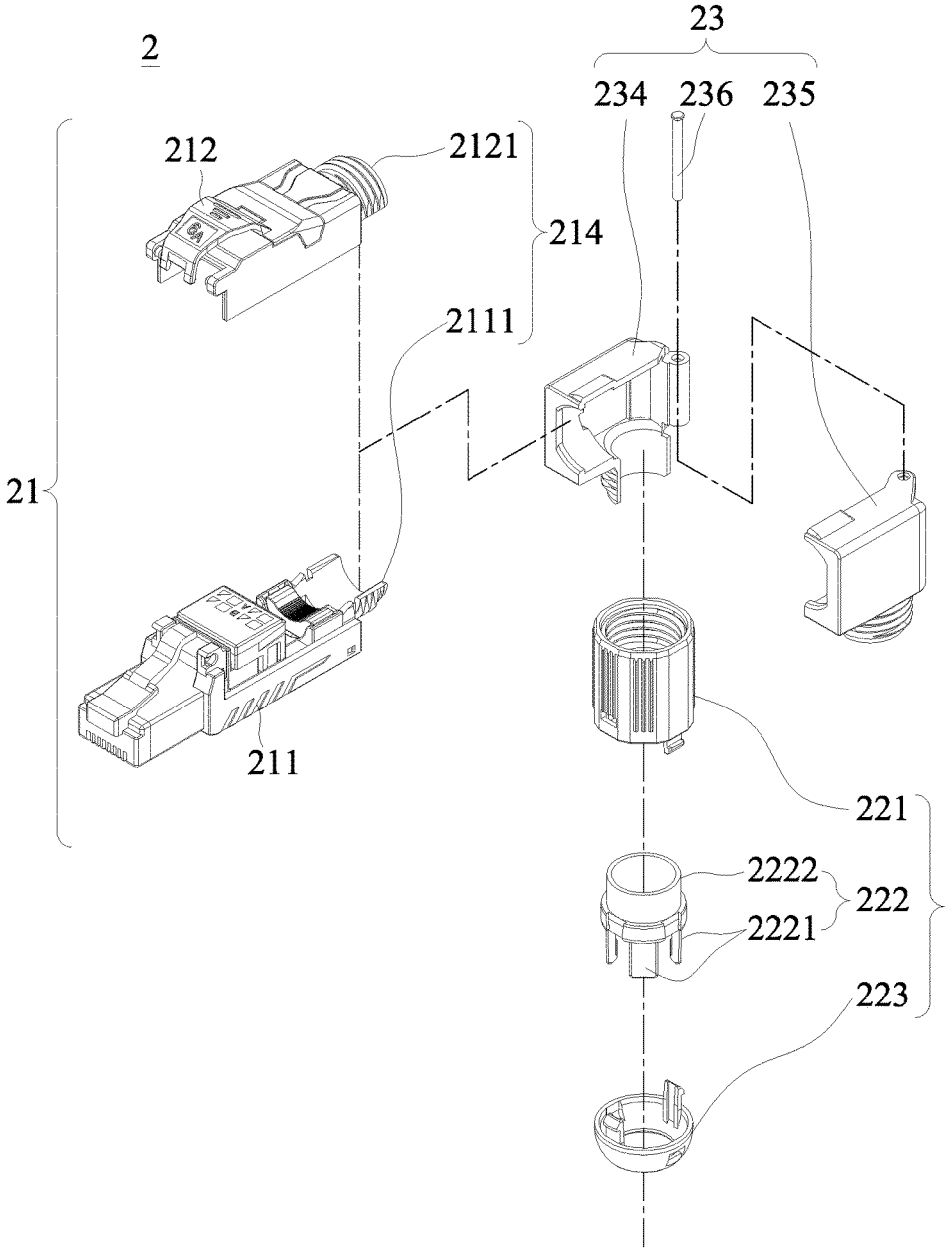
FIG. 7 is an exploded view of a network cable connector in accordance with a second preferred embodiment of the present invention.

The elastic ejection block 3 is installed in the clamping base 211, and the distance from the elastic ejection block 3 to the clamping cover 212 is smaller than the wire diameter of the network cable 4, so that when the network cable 4 presses at the elastic ejection block 3, an expansion force F1 is produced (as shown in FIG. 6), so that the clamping base 211 and the clamping cover 212 will be expanded outwardly. The front end inside the hollow compression device 22 has an inner thread 2211, and the outer thread 215 is screwed into the inner thread 2211, so that the hollow compression device 22 forms an inward compression force F2 (as shown in FIG. 6), and the internal end of the hollow compression device 22 is tapered, so that the hole diameter at an end of the hollow compression device 22 is smaller than the hole diameter of the front end of the hollow compression device 22.

Wherein, a linearly displaceable clamping part 222 is disposed between the internal front end and the end of the hollow compression device 22, and the pushing pipe 214 is provided for pushing the clamping part 222 to an end of the hollow compression device 22. Since the hole diameter of the end of the hollow compression device 22 is smaller than the hole diameter of its front end but slightly greater than the cable diameter of the network cable 4, so that the clamping part 222 is compressed inwardly, and the internal diameter of the clamping part 222 is smaller than the cable diameter of the network cable 4.

When the hollow compression device 22 is screwed into the pushing pipe 214, the clamping base 211 and the clamping cover 212 are expanded outwardly, so that the hollow compression device 22 is locked securely with the pushing pipe 214, while the pushing pipe 214 is pushing the clamping part 222 to the tapered end of the hollow compression device 22 accordingly. Since the clamping part 222 has an internal diameter smaller than the cable diameter of the network cable 4, the clamping part 222 clamps the network cable 4 to form a clamping force F3 (as shown in FIG. 6) while fixing the hollow compression device 22.

With reference to FIGS. 2 to 6 for the exploded view of a network cable connector, the schematic view of a clamping part, the sectional view of the network cable connector, the schematic views of connecting and binding wires in accordance with the first embodiment of the present invention respectively, the network cable connector 2 comprises a main body 21 and a hollow compression device 22.

The main body 21 has a clamping base 211 and a clamping cover 212, and an end of the clamping base 211 is plugged into a network jack, and the other end of the clamping base 211 is extended to form an arc first connecting portion 2111, and the clamping base 211 has a containing portion 2112 for accommodating a network cable, and the clamping cover 212 is configured to be corresponsive to the containing portion 2112, and an end of the clamping cover 212 is coupled to the clamping base 211 by at least one first pivot 213, so that the clamping cover 212 can be lifted opened or closed with respect to the containing portion 2112, and the other end of the clamping cover 212 is extended to form an arc second connecting portion 2121. When the clamping cover 212 is covered onto the containing portion 2112, the first connecting portion 2111 and the second connecting portion 2121 form a pushing pipe 214, and the pushing pipe 214 is communicated to the containing portion 2112, and the outer surface the pushing pipe 214 has a plurality of outer threads 215. In addition, the main body 21 further has a cable connector 216 for connecting the network cable, so that the network cable can be coupled to the main body 21 more easily.

In addition, the hollow compression device 22 is hollow for passing the network cable, and the hollow compression device 22 has a fastener 221, a clamping part 222 and a sleeve member 223, and an end of the fastener 221 is configured to be corresponsive to the outer threads 215 and the inner surface of the fastener 221 has a plurality of inner threads 2211, and the clamping part 222 is installed in the fastener 221, and an end of the clamping part 222 has a plurality of compression parts 2221, and the other end of the clamping part 222 is a pushing part 2222, and the sleeve member 223 is covered onto the end of the fastener 221 having the inner threads 2211, and the inner surface of the sleeve member 223 is a curved surface tapered from an end of the inner threads 2211 to the other end. In this embodiment, two first latch members 2231 are extended and formed on the inner surface of the sleeve member 223, and two first latch holes 2212 are formed at the end of the fastener 221 having the inner threads 2211 and configured to be corresponsive to the first latch members 2231 respectively. In addition, two second latch members 2213 are extended and formed on the inner surface of the fastener 221 and configured to be opposite to an end of the inner threads 2211, and two second latch holes 2232 are formed at an end of the sleeve member 223 and configured to be corresponsive to the second latch members 2213, so that the sleeve member 223 can be fixed onto the fastener 221.

During use, a user may lift open the clamping cover 212 to perform the process of connecting wires. By lifting open the clamping cover 212, the user can see clearly where a core line should be connected. The clamping cover is closed after confirmations are made, and such arrangement makes the wire connection process much more convenient and reduces the manufacturing error. In addition, the cable connector 216 in the main body 21 is provided for compensating any discrepancy for various different way of arranging the network cable, so as to improve the property of the network cable. After the wire is connected, the user passes the network cable through the hollow compression device 22 and secures the network cable towards the main body 21. Now, the clamping part 222 in the fastener 221 will move towards the sleeve member 223 and abut the inner surface of the sleeve member 223, and the curved inner surface is forced by the compression parts 2221 to be withdrawn inwardly to clamp the network cable, so as to fix the network cable and prevent it from shaking. Since the stability of connecting the sleeve member 223 and the fastener 221 is enhanced by the aforementioned engagement mechanism, therefore when the clamping part 222 is pushed to abut the inner surface of the sleeve member 223, the sleeve member 223 will not be pushed or compressed to separate from the fastener 221, so that the hollow compression device 22 can be operated normally. After the network cable is clamped tightly, the tightly clamped portion is not disposed inside the network cable connector 2 but disposed at the rear end of the whole structure, so that there will be no gap between the rear end of the network cable connector 2 and the network cable, and foreign substances such as dust will not enter into the network cable connector 2 easily, so as to achieve the dustproof effect. Since there is no gap at the rear end of the network cable, the network cable will not be shaken by external forces, while affecting the aesthetic effect. Users will not have any doubt about the network cable being not been fixed securely. Such design further has another advantage, since the fastener 221, the clamping part 222 and the sleeve member 223 are not necessarily made of a material with a better ductility, and they may be made of a rigid material to achieve the effect of preventing any component of the hollow compression device 22 from being deformed or damaged by a large pulling force, so as to improve the service life of the network cable connector of the present invention.

Figure 3:
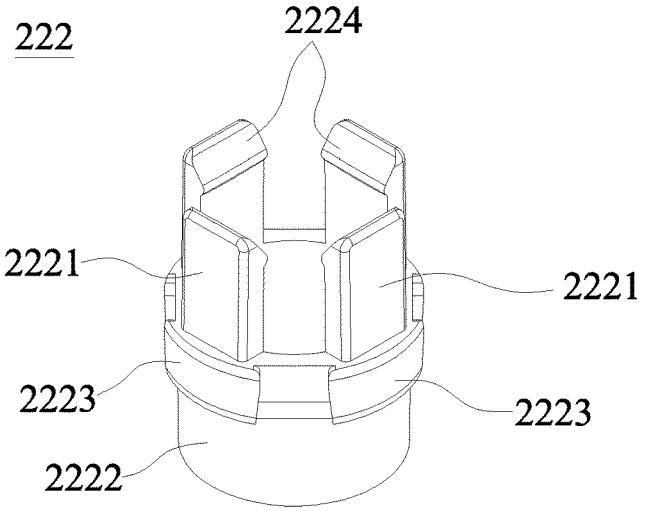
FIG. 3 is a schematic view of a clamping part in accordance with the first preferred embodiment of the present invention.

In this embodiment as shown in FIG. 3, the compression parts 2221 of the clamping part 222 may be partitioned and symmetrically configured, and a limit bump 2223 is formed at the joint of each of the compression parts 2221 and the pushing part 2222, so that after the clamping part 222 is installed into the fastener 221, the clamping part 222 will not move freely in the fastener 221. When the clamping part 222 is pushed by the pushing pipe 214, the clamping part 222 will be just moved in direction towards the sleeve member 223 without deviation, and the limit bumps 2223 are limited by the inner threads 2211 and prevented from falling out from the other end of the fastener 221, so as to ensure the normal operation of the hollow compression device 22. In addition, each of the compression parts 2221 has a compression bump 2224 extended inwardly and formed at an end coupled to the pushing part 2222, so that when the network cable is bound, the packing level of the network cable can be increased to improve the fixedness of the network cable.

Figure 4:
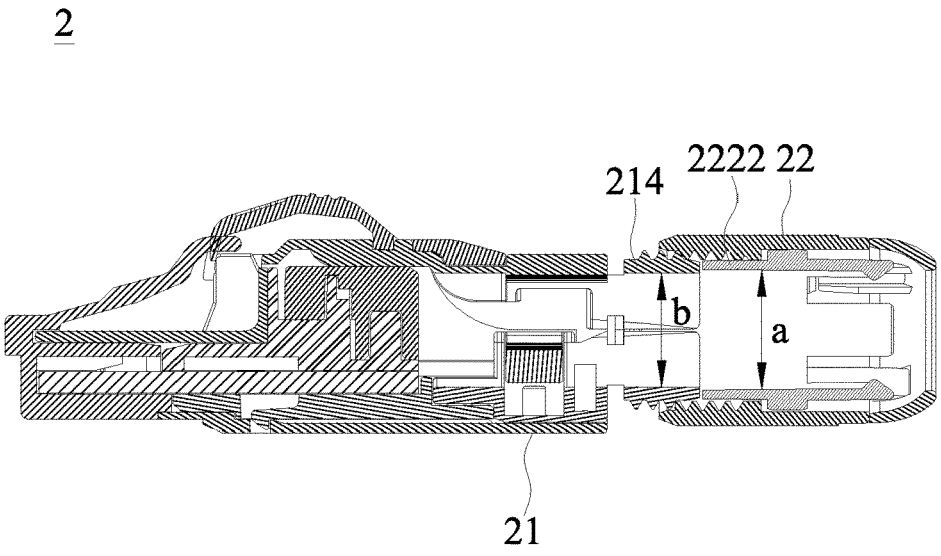
FIG. 4 is a sectional view of a network cable connector in accordance with the first preferred embodiment of the present invention.
Figure 5A:
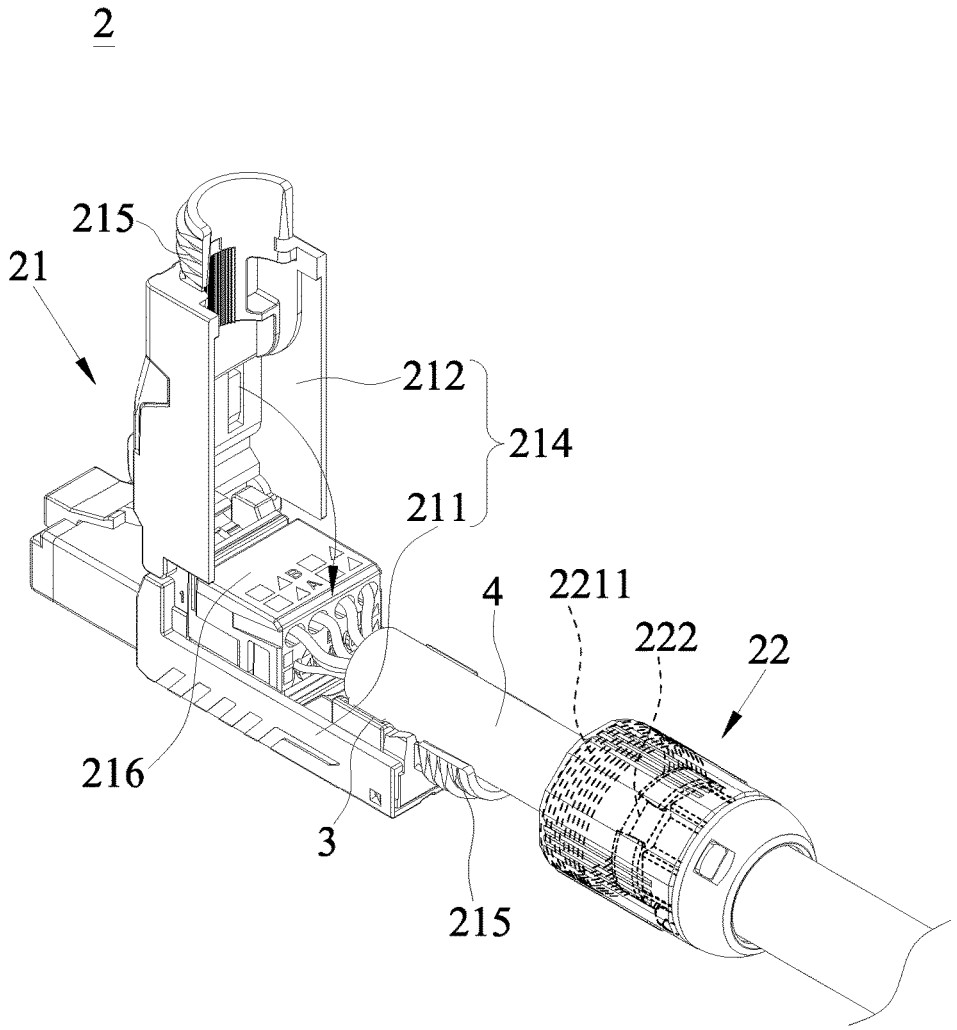
FIG. 5A is a schematic view of connecting the wire of a network cable connector in accordance with the first preferred embodiment of the present invention.
Figure 5B:
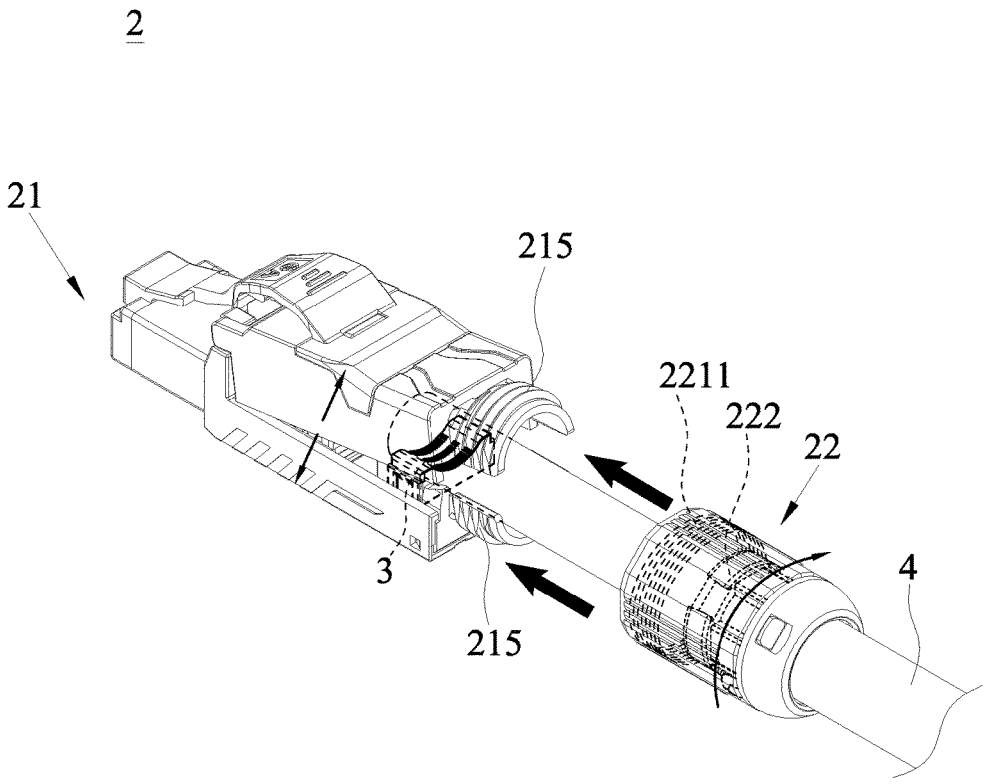
FIG. 5B is a schematic view of operating a network cable connector in accordance with the first preferred embodiment of the present invention.
Figure 5C:
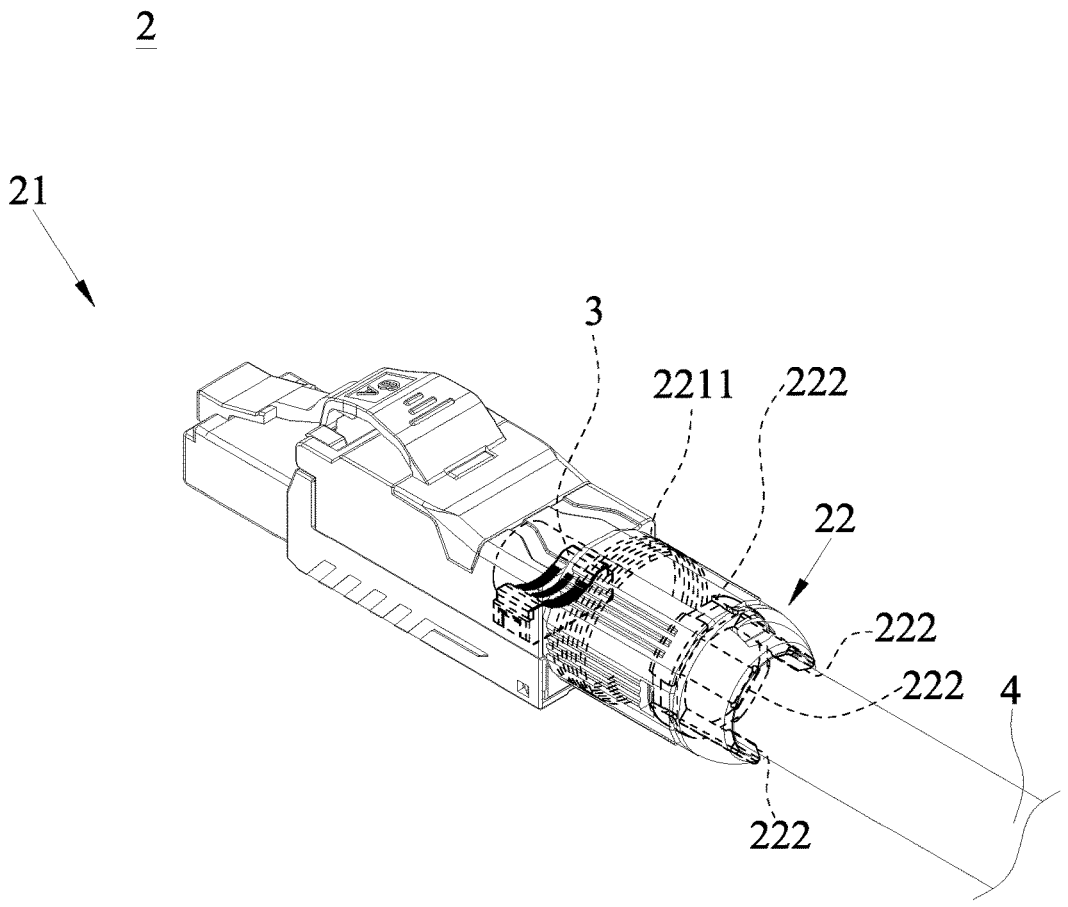
FIG. 5C is a schematic view of a network cable connector in accordance with the first preferred embodiment of the present invention after the wire is tightened securely.

In this embodiment as shown in FIG. 4, the pushing part 2222 is in a tubular shape, and the pushing part 2222 has a diameter (a) equal to the diameter (b) of the pushing pipe 214. In such design, when the pushing part 2222 can be pushed by the pushing pipe 214 more easily when the fastener 221 is screwed in a direction towards the main body 21.

With reference to FIGS. 7 to 10 for the exploded view of a network cable connector, a schematic view of a direction changing member, the sectional view and schematic view of binding the network cable connector in accordance with the second embodiment of the present invention respectively, this embodiment further enhances the bent portion of the network cable (compared with the first embodiment). This embodiment further comprises a direction changing member 23 for passing the network cable, and the direction changing member 23 has a connection port 231 and a connecting pipe 232, and the connection port 231 and the connecting pipe 232 are communicated to each other and have an included angle θ, and the angle θ is greater than or equal to 90 degrees and smaller than 180 degrees in order to changing the configuration direction of the network cable, and the connection port 231 is coupled to the pushing pipe 214, and the outer surface of the connecting pipe 232 has a plurality of third threads 233, and the hollow compression device 22 is screwed and coupled to the connecting pipe 232 of the direction changing member 23. In addition, the outer surface of an end of the pushing pipe 214 has a plurality of outer threads 215, and an end coupled to the main body 21 has the outer threads 215, and the description of the remaining components is the same as the first embodiment and thus will not be repeated.

In this embodiment, the direction changing member 23 has a first casing 234 and a second casing 235, and the first casing 234 is coupled to the second casing 235 by a second pivot 236, and such arrangement allows users to lift open or close the first casing 234 and the second casing 235. Wherein, when the first casing 234 and the second casing 235 are closed and engaged with each other, the direction changing member 23 forms the connection port 231 and the connecting pipe 232, and such design makes the direction changing member 23 to become a detachable structure.

During use, a user may lift open the clamping cover 212 to facilitate the wire connection process. Further, an end of the direction changing member 23 having the connection port 231 is sheathed on the pushing pipe 214, and the feature of having an included angle θ between the connection port 231 and the connecting pipe 232 allows the network cable in the direction changing member 23 to be bent in order to change the outlet direction of the network cable. With the lifting design of the direction changing member 23, the direction changing member 23 installed onto the main body 21 is detachable to improve the convenience of assembling, and both installation or un-installation do not require changing the structure of the main body 21 to ensure the structural integrity of the main body 21. When the network cable is tightened, the hollow compression device 22 is screwed and coupled to the direction changing member 23 to fix the bent network cable. In the tightening method, the connecting pipe 232 pushes the clamping part 222 to move by screw connection during the tightening process, so that the compression parts 2221 clamps and fixes the network cable tightly, and after the network cable is clamped tightly, there will be no gap between the rear end of the network cable connector 2 and the network cable, so as to achieve both dustproof and aesthetic effects. Since the direction changing member 23 is detachable, therefore if a user wants to change the design of the network cable, the wire is not necessarily bent, but just directly pulled out. After the direction changing member 23 is removed, the hollow compression device 22 is screwed and coupled to the pushing pipe 214 of the main body 21 to complete the change. Therefore, the invention can avoid reinstalling the network cable connector 2 for every time of making a change, so as to improve the convenience of use.

Figure 8:
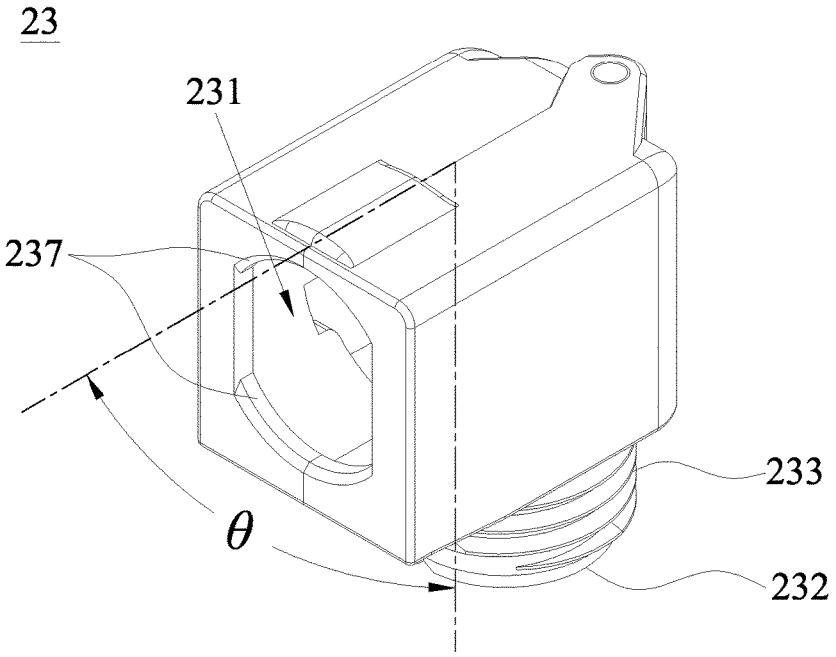
FIG. 8 is a schematic view of a direction changing member in accordance with a second preferred embodiment of the present invention.

In this embodiment as shown in FIG. 8, two limit parts 237 are installed symmetrically at the connection port 231, and when the connection port 231 and the pushing pipe 214 are coupled, the limit parts 237 are latched to an end of the pushing pipe 214 opposite to the outer threads 215 and provided for installing the direction changing member 23 to the main body 21. Since the joint of the limit parts 237 and the pushing pipe 214 does not have the outer threads 215, therefore a recessed form is formed with respect to the outer threads 215. When the direction changing member 23 is pulled outward, the limit parts 237 are latched by the outer threads 215 and cannot be moved outward anymore, so as to ensure the stability of the connection between the direction changing member 23 and the main body 21. By screwing the hollow compression device 22 to the connecting pipe 232, the direction changing member 23 cannot be lifted open, so that the clamping cover 212 cannot be lifted open to achieve a very stable status after the components are connected.

Figure 9:
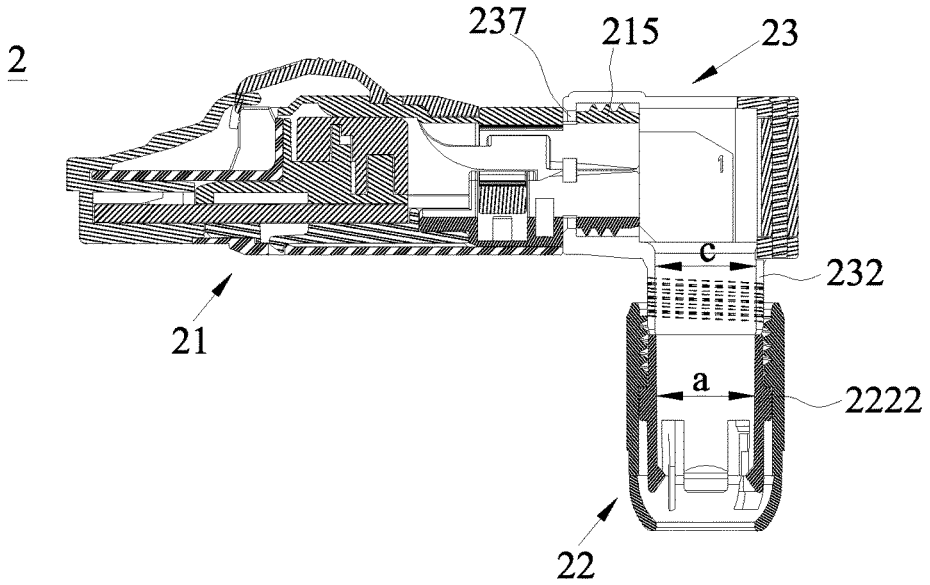
FIG. 9 is a sectional view of a network cable connector in accordance with a second preferred embodiment of the present invention.
Figure 10:
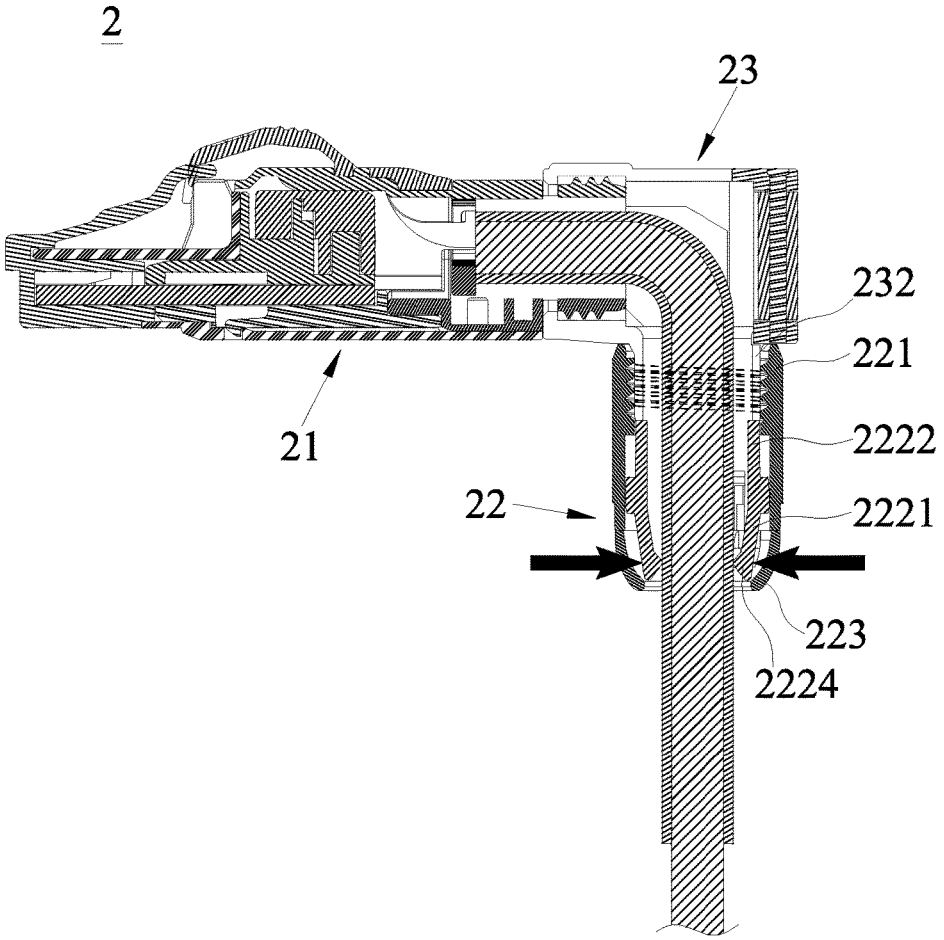
FIG. 10 is a schematic view of tightening a network cable connector securely in accordance with the second preferred embodiment of the present invention.

In this embodiment as shown in FIG. 9, the pushing part 2222 is in a tubular shape, and the pushing part 2222 has a diameter (a) equal to the diameter (c) of the connecting pipe 232. In such design, the pushing part 2222 can be pushed by the connecting pipe 232 more easily when the fastener 221 is screwed towards the direction changing member 23.

In summation of the description above, the structural design of the present invention makes the wire connection process more conveniently, and after the network cable is clamped, no gap is formed between the rear end of the network cable connector 2 and the network cable, so as to prevent foreign substances such as dust from entering into the network cable connector and also prevent the network cable from shaking or resulting in an ugly appearance. In addition, the detachable design of the direction changing member 23 provides a more convenient installation for users, and the screw connection method allows users to change a network cable without reinstalling the network cable connector 2, so as to improve the convenience of use.

What is claimed is:

1. A network cable connector, comprising:

a main body, with a front end plugged into an external network jack, and with an end plugged into an external network cable, and the main body having a clamping base and a clamping cover, and the clamping cover being pivotally coupled to the clamping base, such that when the clamping cover is opened, the network cable is received, and when the clamping cover is closed and engaged with the clamping base, a pushing pipe is formed, and the pushing pipe also has an outer thread formed thereon;

an elastic ejection block, installed in the clamping base, and a distance between the elastic ejection block and the clamping cover being smaller than a cable diameter of the network cable, so that when the network cable presses the elastic ejection block, an expansion force is produced to expand the clamping base and the clamping cover outwardly; and a hollow compression device, with an internal front end having an inner thread, and the outer thread being screwed into the inner thread, so that the hollow compression device produces a compression force towards the inside, and the hollow compression device has a tapered internal end, so that an end of the hollow compression device has a hole diameter smaller than a hole diameter of the front end, wherein a linearly displacing clamping part is disposed between the internal front end and the end of the hollow compression device, and the pushing pipe pushes the clamping part to move to an end of the hollow compression device, and the clamping part compresses towards the inside, so that the clamping part has an internal diameter smaller than the cable diameter of the network cable;

when the hollow compression device is screwed into the pushing pipe, the clamping base and the clamping cover are expanded towards outside, so that the hollow compression device is locked securely to the pushing pipe, while the pushing pipe is pushing the clamping part to move to the tapered end of the hollow compression device, and since the clamping part has an internal diameter smaller than the cable diameter of the network cable, the clamping part is clamped securely to the network cable to form a clamping force, while fixing the hollow compression device.

2. A network cable connector, comprising:

a main body, having a clamping base and a clamping cover, and an end of the clamping base being provided for plugging into a network jack, and an another end of the clamping base being extended to form a first connecting portion in an arc shape, and the clamping base having a containing portion for receiving the network cable, and the clamping cover being configured to be corresponsive to the containing portion and an end of the clamping cover being coupled to the clamping base through at least one first pivot, such that the clamping cover may be lifted open or closed with respect to the containing portion, and the other end of the clamping cover being extended to form an arc second connecting portion; wherein when the clamping cover is covered onto and engaged with the containing portion, the first connecting portion and the second connecting portion are formed into a pushing pipe, and the pushing pipe is communicated to the containing portion, and the outer surface of the pushing pipe has a plurality of outer threads; and a hollow compression device, being hollow for passing a network cable, and having a fastener, a clamping part and a sleeve member, and an end of the fastener having plurality of inner threads formed on an inner surface of the fastener and configured to be corresponsive to the outer threads, and the clamping part being installed in the fastener, and an end of the clamping part having a plurality of compression parts, and the other end of the clamping part being a pushing part, and the sleeve member being covered onto and engaged with an end of the fastener having the inner threads, and the inner surface of the sleeve member being a curved surface tapered from an end near the fastener to the other end;

wherein when the hollow compression device and the main body are screwed and coupled securely, the pushing part is pushed by the pushing pipe to move the clamping part towards the sleeve member, so that the compression parts are compressed inwardly by the curved inner surface of the sleeve member to clamp the network cable tightly.

3. The network cable connector of claim 2, wherein the sleeve member has two first latch members extended from and formed at the inner surface of the sleeve member, and the fastener has two first latch holes formed at an end having the inner threads and configured to be corresponsive to the first latch members respectively, and the fastener has two second latch members extended and formed from the inner surface of an end having the inner threads, and the sleeve member has two second latch holes formed thereon and configured to be corresponsive to the second latch members respectively, and the compression parts are partitioned and symmetrically configured with each other, and a limit bump is formed at the joint of each of the compression parts and the pushing part.

4. The network cable connector of claim 3, wherein the pushing part is in a tubular shape, and the pushing part has a diameter equal to the diameter of the pushing pipe, and each of the compression parts has a compression bump extended inwardly from and formed at an end coupled to the pushing part.

5. A network cable connector, comprising:

a main body, having a clamping base and a clamping cover, and an end of the clamping base being provided for plugging into a network jack, and an another end of the clamping base being extended and formed a first connecting portion, and the clamping base having a containing portion provided for accommodating a network cable, and the clamping cover being configured to be corresponsive to the containing portion, and an end of the clamping cover being coupled to the clamping base by at least one first pivot, so that the clamping cover can be lifted open or closed with respect to the containing portion, and an another end of the clamping cover being extended and formed a second connecting portion; wherein when the clamping cover is covered and engaged with the containing portion, the first connecting portion and the second connecting portion form a pushing pipe, and the pushing pipe is communicated to the containing portion, and an outer surface of an end of the pushing pipe has a plurality of outer threads;

a direction changing member, for passing the network cable, and the direction changing member having a connection port and a connecting pipe, and the connection port and the connecting pipe being communicated to each other and having an included angle for changing the configuration direction of the network cable, and the connection port being coupled to the pushing pipe, the outer surface of the connecting pipe having a plurality of third threads; and a hollow compression device, being hollow, and provided for passing the network cable, and the hollow compression device having a fastener, a clamping part and a sleeve member, and an end of the fastener having a plurality of inner threads formed on the inner surface of the end of the fastener and configured to be corresponsive to the third threads, and the clamping part being installed in the fastener, and an end of the clamping part having a plurality of compression parts, and the other end of the clamping part having a pushing part, and the sleeve member being covered onto and engaged with an end of the fastener having the inner threads, and the inner surface of the sleeve member being a curved surface and tapered from an end near the fastener to the other end;

wherein, when the hollow compression device and the direction changing member are screwed securely, the pushing part is driven by the connecting pipe to move the clamping part towards the sleeve member, so that the compression parts are compressed inwardly by the curved inner surface of the sleeve member to clamp the network cable tightly.

6. The network cable connector of claim 5, wherein the direction changing member comprises a first casing and a second casing, and the first casing and the second casing are coupled to each other by a second pivot for lifting open and closing the first casing and the second casing; wherein when the first casing and the second casing are engaged with each other and closed, the direction changing member forms the connection port and the connecting pipe, and the connection port and the connecting pipe have an included angle greater than or equal to 90 degrees and smaller than 180 degrees.

7. The network cable connector of claim 6, wherein the connection port has two limit parts symmetrically disposed thereon, and when the connection port and the pushing pipe are coupled, the limit parts are latched to an end of the pushing pipe corresponsive to the outer threads for installing the direction changing member to the main body.

8. The network cable connector of claim 7, wherein the sleeve member has two first latch members extended from and formed at the inner surface of the sleeve member, and the fastener has two first latch holes formed at the end having the inner threads and configured to be corresponsive to the first latch members respectively, wherein the fastener has two second latch members extended from and formed at the inner surface of the end having the inner threads, and the sleeve member has two second latch holes formed thereon and configured to be corresponsive to the second latch members respectively, and the compression parts are partitioned and symmetrically configured with each other, and a limit bump is formed at the joint of each of the compression parts and the pushing part.

9. The network cable connector of claim 8, further comprising a limit groove formed between two adjacent limit bumps, and the pushing part having a diameter equal to the diameter of the connecting pipe.

10. The network cable connector of claim 9, wherein each of the compression part has a compression bump formed thereon and configured to be corresponsive to an end coupled to the pushing part.

* * * * *